US009161645B1

(12) United States Patent
Liao

(10) Patent No.: US 9,161,645 B1
(45) Date of Patent: Oct. 20, 2015

(54) CARD-LIKE PORTABLE SHOEHORN

(71) Applicant: Liven Fineness (Taiwan) Co., Ltd., New Taipei (TW)

(72) Inventor: Ching-Shui Liao, New Taipei (TW)

(73) Assignee: LIVEN FINENESS (TAIWAN) CO., LTD., New Taipei (TW)

( * ) Notice: Subject to any disclaimer, the term of this patent is extended or adjusted under 35 U.S.C. 154(b) by 0 days.

(21) Appl. No.: 14/575,932

(22) Filed: Dec. 18, 2014

(51) Int. Cl.
*A47G 25/82* (2006.01)

(52) U.S. Cl.
CPC ..... *A47G 25/82* (2013.01)

(58) Field of Classification Search
CPC ..... A47G 25/80; A47G 25/82
USPC ..... 223/113, 118, 119
See application file for complete search history.

(56) References Cited

U.S. PATENT DOCUMENTS

| | | | | | |
|---|---|---|---|---|---|
| 865,462 | A * | 9/1907 | Weeks | 223/118 |
| D75,018 | S * | 5/1928 | Gouglass | D2/642 |
| 1,913,709 | A * | 6/1933 | Gutmann | 223/118 |
| 3,396,883 | A * | 8/1968 | Batista | 223/118 |
| 3,436,000 | A * | 4/1969 | Batista | 223/118 |
| 3,788,531 | A * | 1/1974 | Oldfield | 223/118 |
| D382,686 | S * | 8/1997 | Litwin et al. | D2/642 |
| 6,065,654 | A * | 5/2000 | Evensen | 223/113 |
| 6,318,607 | B1 * | 11/2001 | Koskela | 223/118 |
| 6,695,182 | B1 * | 2/2004 | Shrewsbury | 223/113 |
| 2006/0144880 | A1 * | 7/2006 | Bromberg | 223/118 |
| 2013/0214017 | A1 * | 8/2013 | Saggar | 223/118 |

* cited by examiner

*Primary Examiner* — Nathan Durham
(74) *Attorney, Agent, or Firm* — Muncy, Geissler, Olds & Lowe, P.C.

(57) ABSTRACT

Provided is a card-like portable shoehorn, comprising a body, characterized in that: the body is plate-shaped; the body has a thick hard portion, a taper portion, and a thin soft portion; the taper portion tapers toward the thin soft portion; and the thin soft portion is thinner than the thick hard portion. Hence, the thick hard portion and the thin soft portion together operate in a manner to allow a user to stretch the shoe's counter outward with the thick hard portion and exert a force on the thin soft portion with the user's heel so as to bend the thin soft portion, thereby allowing the body to function as a shoehorn.

4 Claims, 5 Drawing Sheets

CARD-LIKE PORTABLE SHOEHORN

BACKGROUND OF THE INVENTION

1. Technical Field

The present invention relates to shoehorns, and more particularly, to a card-like portable shoehorn whereby a user stretches the shoe's counter outward with the thick hard portion and exerts a force on the thin soft portion with the user's heel so as to bend the thin soft portion, thereby allowing the body to function as a shoehorn.

2. Description of Related Art

A shoehorn or shoe horn is a tool that lets the user put on a shoe more easily. Referring to FIG. 1, a conventional shoehorn 2 is essentially plate-shaped and smooth, with one end to be held by a user and the other end functioning as a sliding channel which bends centrally and inward. The conventional shoehorn 2 is traditionally made of metal or wood but is nowadays made mostly of plastic. A user puts the conventional shoehorn 2 into the heel of a shoe in order to put on the shoe easily and quickly.

Although the conventional shoehorn 2 lets the user put on a shoe more easily, its shape compromises its portability. As a result, the conventional shoehorn 2 still has room for improvement.

SUMMARY OF THE INVENTION

In view of the aforesaid drawbacks of the prior art, the inventor of the present invention conceived room for improvement in the prior art and thus conducted extensive researches and experiments according to the inventor's years of experience in the related industry, and finally developed a AAA as disclosed in the present invention.

It is an objective of the present invention to provide a card-like portable shoehorn whereby a user stretches the shoe's counter outward with the thick hard portion and exerts a force on the thin soft portion with the user's heel so as to bend the thin soft portion, thereby allowing the body to function as a shoehorn.

In order to achieve the above and other objectives, the present invention provides a card-like portable shoehorn, comprising a body, characterized in that: the body is rectangular plate-shaped with two opposite shortened edges and two opposite elongated edges each having a first thickness; the body has a thick hard portion, a taper portion, and a thin soft portion, wherein the thick hard portion is located at an upper part of the body, the taper portion and the thin soft portion are located at a lower part of the body, the taper portion is formed with a first sidewall and a second sidewall jointed with the first sidewall at an end, the first and second sidewalls surround a part of an outer circumference of the thin soft portion and have two opposite outermost edges respectively configured as the two opposite outermost elongated edges in the lower part of the body, and the first sidewall, the second sidewall, and a third sidewall of the thin soft portion are outwardly extended along the two opposite elongated edges to terminate on one of the two opposite shortened edges of the body, the third sidewall of the thin soft portion has a second thickness lesser than the first thickness, wherein the first and second sidewalls of the taper portion respectively taper toward the thin soft portion along one of the shortened edges of the body so that the first and second sidewalls are gradually gradient toward the third sidewall, and the taper portion tapers toward the thin soft portion, with the thin soft portion thinner than the thick hard portion. Hence, the thick hard portion and the thin soft portion together operate in a manner to allow a user to stretch the shoe's counter outward with the thick hard portion, sliding the user's heel into the shoe with the taper portion, and exert a force on the thin soft portion with the user's heel so as to bend the thin soft portion, for inserting the user's heel into the shoe with the thin soft portion by way of the bent thin soft portion, thereby allowing the body to function as a shoehorn.

In a preferred embodiment, the taper portion is hemispherical to fit the human heel.

In a preferred embodiment, the body further comprises a handheld portion.

The body of the present invention comprises a thick hard portion, a taper portion, and a thin soft portion and is characterized in that: with the thick hard portion being thick and the thin soft portion being thin, a user holds the body by hand, stretches the shoe's counter outward with the thick hard portion, and exerts a force on the thin soft portion with the user's heel to bend the thin soft portion, thereby allowing the body to function as a shoehorn.

BRIEF DESCRIPTION OF THE SEVERAL VIEWS OF THE DRAWINGS

The technical means and structures disclosed hereunder to achieve the aforesaid objectives and functions of the present invent as well as the features of the present invention are hereunder illustrated with preferred embodiments in conjunction with the accompanying drawings, in which.

DETAILED DESCRIPTION OF THE EMBODIMENT OF THE INVENTION

Figure 1:
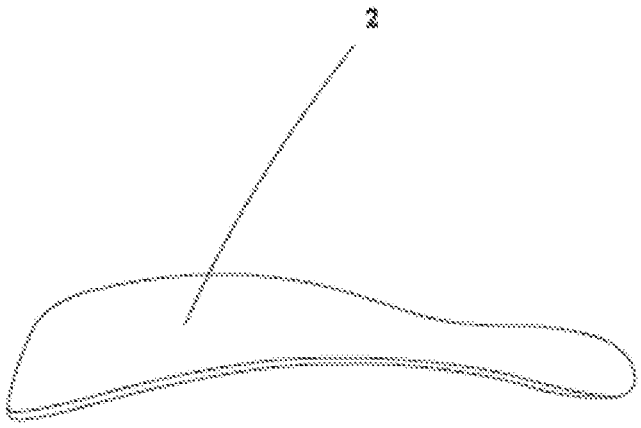
Fig.1 Prior Art
FIG. 1 (PRIOR ART) is a perspective view of a conventional shoehorn.
Figure 2:
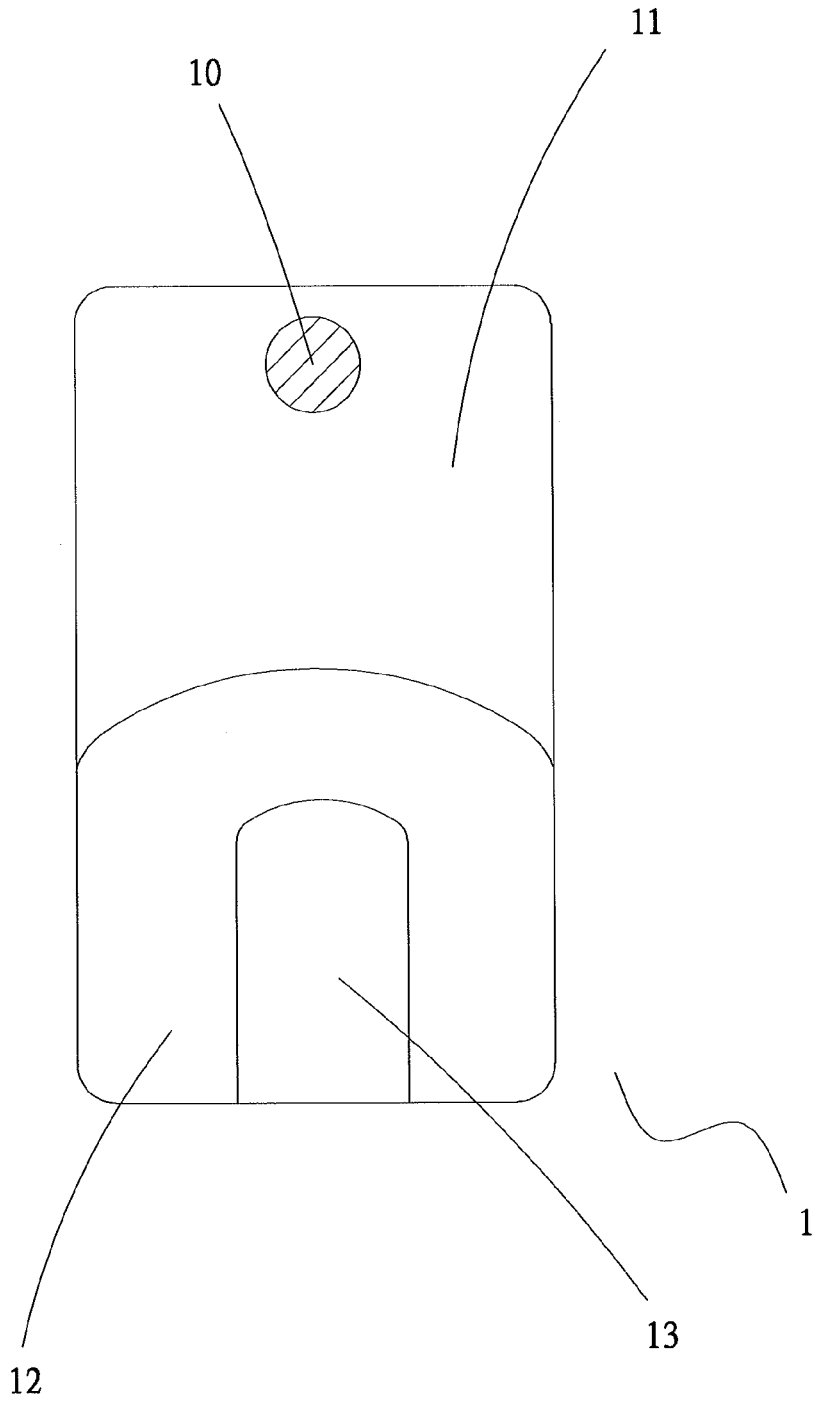
FIG. 2 is a top view of a card-like portable shoehorn according to a preferred embodiment of the present invention.
Figure 3:
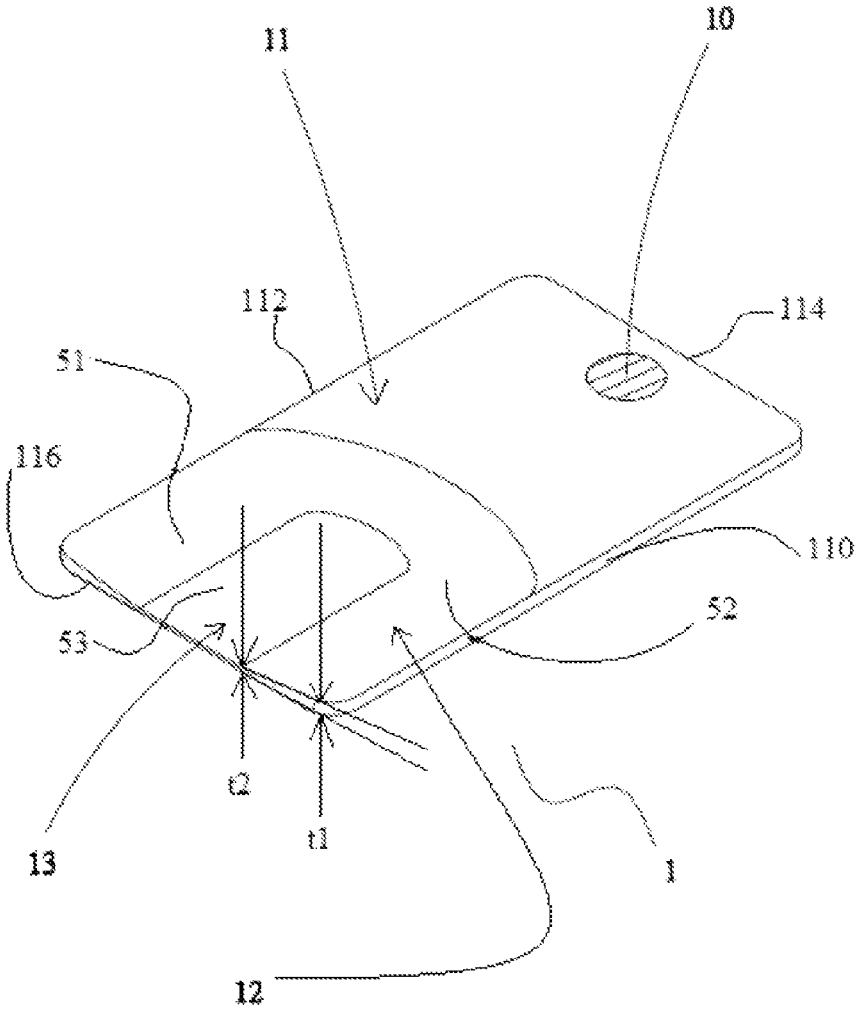
FIG. 3 is a perspective view of the card-like portable shoehorn according to the preferred embodiment of the present invention.

Referring to FIGS. 2, 3, an embodiment of the present invention provides a card-like portable shoehorn which comprises a body 1. Preferably, the body 1 is made of a rigid plastic. The body 1 is plate-shaped. In this embodiment, the body 1 is rectangular and plate-shaped.

The body 1 is rectangular plate-shaped with two opposite shortened edges 114,116 and two opposite elongated edges 110, 112 each having a first thickness t1, and has a thick hard portion 11, a taper portion 12, and a thin soft portion 13. The thick hard portion 11 is 2 mm thick, but the present invention is not limited thereto. The taper portion 12 tapers toward the thin soft portion 13, for example, starting with a thickness of 2 mm and then thinning to 0.5 mm. In this embodiment, the taper portion 12 is hemispherical to fit the human heel. The thin soft portion 13 is thinner than the thick hard portion 11. The thin soft portion 13 is flat and is 0.5 mm thick. The thick hard portion 11 is located at an upper part of the body 1, the taper portion 12 and the thin soft portion 13 are located at a lower part of the body 1, the taper portion 12 is formed with a first sidewall 51 and a second sidewall 52 jointed with the first sidewall 51 at an end, the first 51 and second 52 sidewalls surround a part of an outer circumference of the thin soft portion 13 and have two opposite outermost edges respectively configured as the two opposite outermost elongated edges 110, 112 in the lower part of the body 1, and the first sidewall 51, the second sidewall 52, and a third sidewall 53 of the thin soft portion 13 are outwardly extended along the two opposite elongated edges 110, 112 to terminate on the shortened edge 116 of the body 1, the third sidewall 53 of the thin soft portion 13 has a second thickness t2 lesser than the first thickness t1, wherein the first 51 and second 52 sidewalls of the taper portion 12 respectively taper toward the thin soft portion 13 along one of the shortened edges 114, 116 of the body 1 so that the first 51 and second 52 sidewalls are gradually gradient toward the third sidewall 53, but the present invention is not limited thereto. In this embodiment, the taper portion 12 is the thinnest part of the body 1. The thick hard portion 11 and the thin soft portion 13 operate together in a manner to allow a user to stretch the shoe's counter outward with the thick hard portion 11, sliding the user's heel into the shoe with the taper portion 12, and exert a force on the thin soft portion 13 with the user's heel so as to bend the thin soft portion 13, for inserting the user's heel into the shoe with the thin soft portion 13 by way of the bent thin soft portion 13, thereby allowing the body 1 to function as a shoehorn.

The body 1 further comprises a handheld portion 10. The surface of the handheld portion 10 is coarse or has a plurality of raised points, such that the user can have a tight grip of the body 1.

Figure 4:
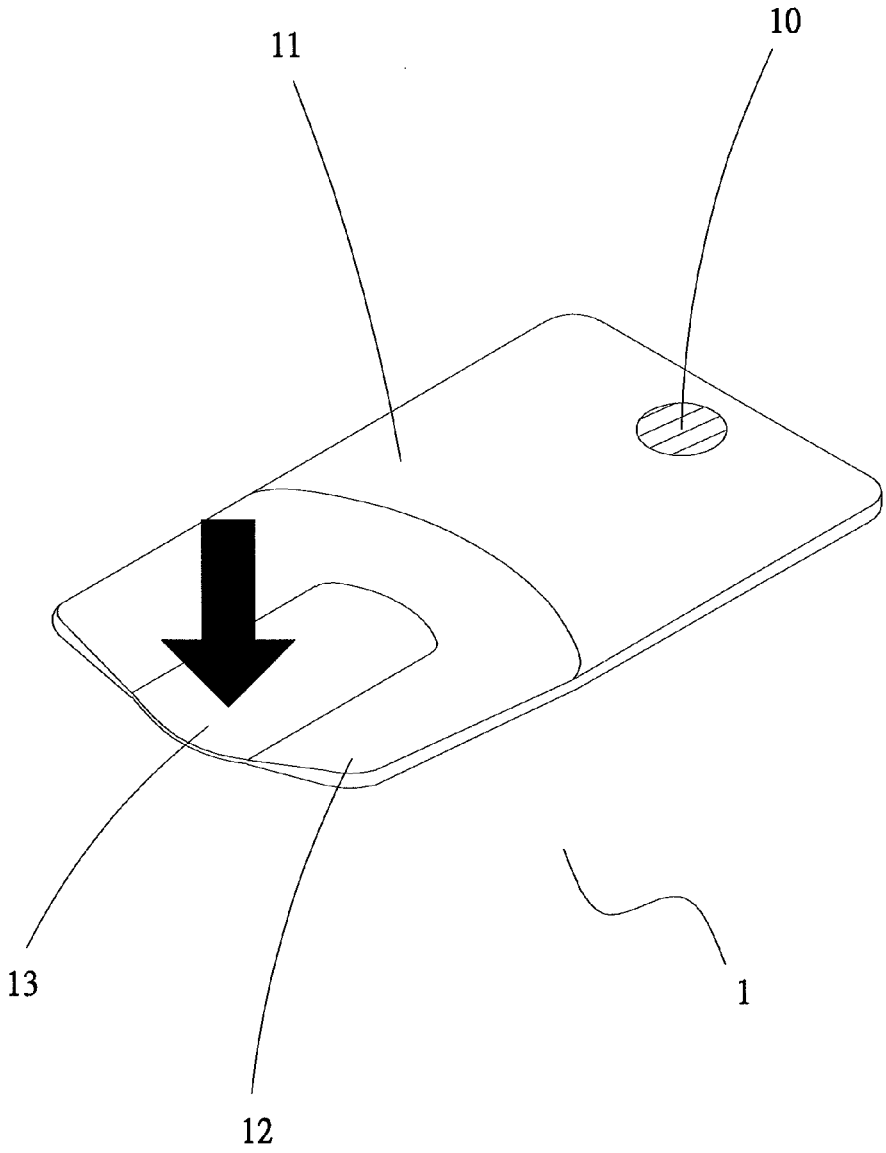
FIG. 4 is a schematic view of implementation of the card-like portable shoehorn according to the preferred embodiment of the present invention.

The operating principles of the present invention are hereunder described in terms of the aforesaid structures and elements. Referring to FIG. 4, with the thick hard portion 11 being thick and the thin soft portion 13 being soft, the user holds the body 1 by hand, stretches the shoe's counter outward with the thick hard portion 11, slides the user's heel into the shoe with the taper portion 12, and eventually inserts the user's heel into the shoe with the thin soft portion 13 because of the curvature and smoothness thereof.

The card-like portable shoehorn of the present invention is characterized in that: the body 1 has a thickness which varies to render the body 1 increasingly soft or hard; with the thick hard portion 11 and the thin soft portion 13 operating in conjunction with each other, the user stretches the shoe's counter outward with the thick hard portion 11 and exerts a force on the thin soft portion 13 with the user's heel to bend the thin soft portion 13, thereby allowing the body 1 to function as a shoehorn. Specifically speaking, the user uses his or her thumb and index finger in holding the handheld portion 10 of the body 1 firmly, stretches the shoe's counter outward with the thick hard portion 11, inserts the user's foot into the shoe, and exerts a force on the thin soft portion 13 with the user's heel to bend the thin soft portion 13, such that the thin soft portion 13 bends inward to fit the user's heel, thereby allowing the user's heel to slide into the shoe easily and quickly.

Figure 5:
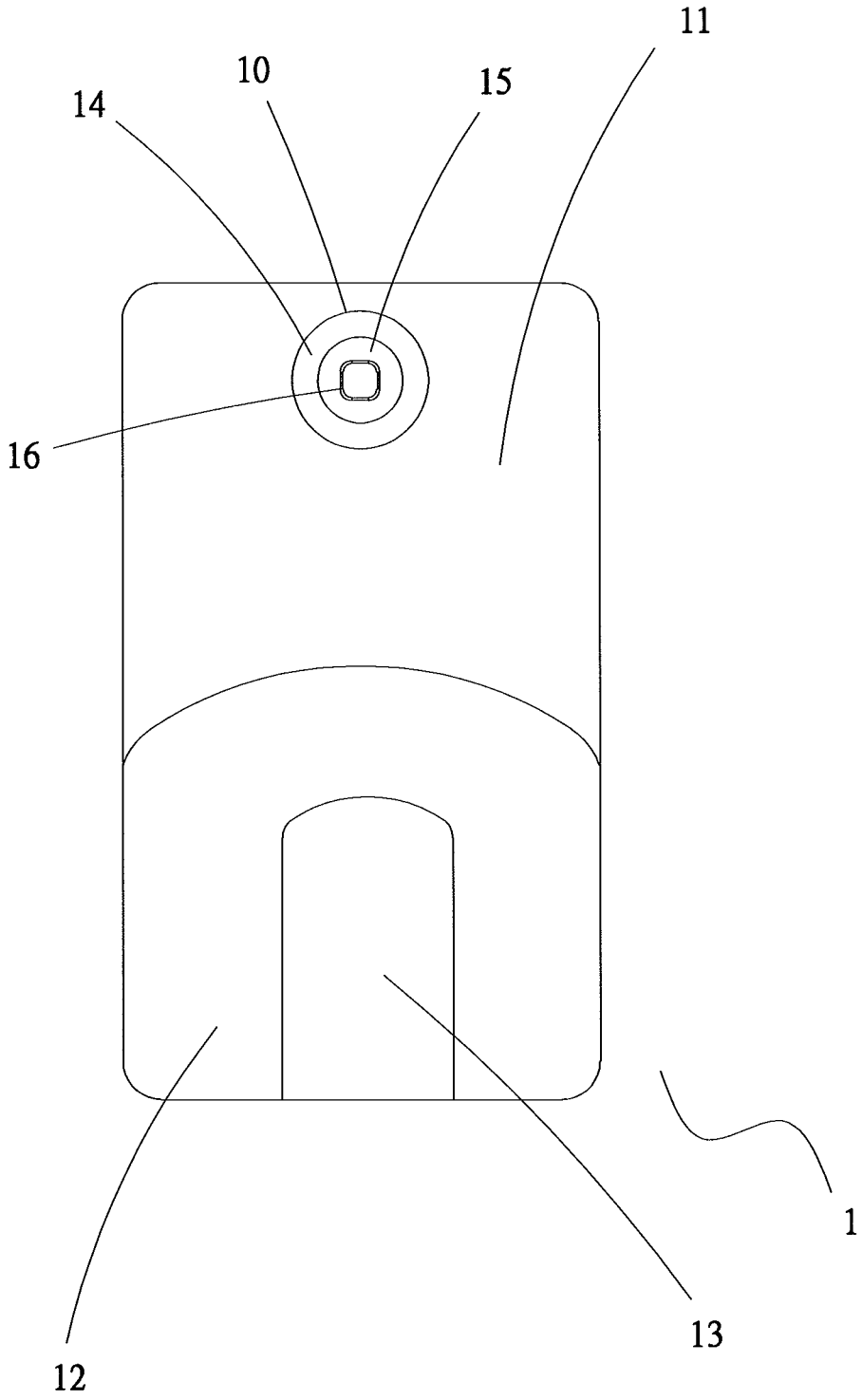
FIG. 5 is a top view of the card-like portable shoehorn according to another embodiment of the present invention.

Referring to FIG. 5, the handheld portion 10 is defined, from the outermost to the innermost, with an oblique region 14, a flat region 15, and a bulging region 16. The oblique region 14 is becoming thinner in the inward direction. The flat region 15 is flat and does not tilt. The bulging region 16 bulges intermittently. Hence, the user can have a tight grip of the body 1.

Referring to all the diagrams, as compared to the prior art, the present invention has advantages as follows: the user stretches the shoe's counter outward with the thick hard portion 11 and exerts a force on the thin soft portion 13 with the user's heel to bend the thin soft portion 13, thereby allowing the body 1 to function as a shoehorn. The card-like portable shoehorn of the present invention is advantageous in that it has a simple but innovative structure and is portable.

The present invention is disclosed above by preferred embodiments. However, the preferred embodiments are illustrative of the present invention only, but should not be interpreted as restrictive of the scope of the claims of the present invention. Hence, all simple modifications and equivalent structural variations made to the aforesaid embodiments according to the disclosure contained in the specification and drawings of the present invention should fall within the scope of the present invention.

What is claimed is:

1. A card-like portable shoehorn, comprising a body, characterized in that: the body is rectangular plate-shaped with two opposite shortened edges and two opposite elongated edges each having a first thickness, and has a thick hard portion, a taper portion, and a thin soft portion, wherein the thick hard portion is located at an upper part of the body, the taper portion and the thin soft portion are located at a lower part of the body, the taper portion is formed with a first sidewall and a second sidewall jointed with the first sidewall at an end, the first and second sidewalls surround a part of an outer circumference of the thin soft portion and have two opposite outermost edges respectively configured as the two opposite outermost elongated edges in the lower part of the body, and the first sidewall, the second sidewall, and a third sidewall of the thin soft portion are outwardly extended along the two opposite elongated edges to terminate on one of the two opposite shortened edges of the body, the third sidewall of the thin soft portion has a second thickness lesser than the first thickness, wherein the first and second sidewalls of the taper portion respectively taper toward the thin soft portion along one of the shortened edges of the body so that the first and second sidewalls are gradually gradient toward the third sidewall, and the taper portion tapers toward the thin soft portion, with the thin soft portion thinner than the thick hard portion, such that the thick hard portion and the thin soft portion operate together in a manner to allow a user to stretch the shoe's counter outward with the thick hard portion, sliding the user's heel into the shoe with the taper portion, and exert a force on the thin soft portion with the user's heel to bend the thin soft portion, for inserting the user's heel into the shoe with the thin soft portion by way of the bent thin soft portion, thereby allowing the body to function as a shoehorn.

2. The card-like portable shoehorn of claim 1, wherein the taper portion is hemispherical to fit a human heel.

3. The card-like portable shoehorn of claim 1, wherein the body further comprises a handheld portion.

4. The card-like portable shoehorn of claim 1, wherein the handheld portion is defined, from the outermost to the innermost, with an oblique region, a flat region, and a bulging region.

* * * * *